United States Patent [19]

Strauss et al.

[11] 4,208,614

[45] Jun. 17, 1980

[54] HIGH INTENSITY DISCHARGE LAMP WITH INTEGRAL MEANS FOR ARC EXTINGUISHING

[75] Inventors: Herbert S. Strauss, Paramus; Lawrence Sheinberg, Howell Township, both of N.J.

[73] Assignee: Duro-Test Corp., North Bergen, N.J.

[21] Appl. No.: 959,457

[22] Filed: Nov. 13, 1978

Related U.S. Application Data

[62] Division of Ser. No. 577,096, May 13, 1975, Pat. No. 4,156,830.

[51] Int. Cl.[2] ..... H01J 7/44; H01J 13/46; H01J 19/78; H01K 1/62

[52] U.S. Cl. ..... 315/73; 315/74; 315/75; 315/119; 313/184

[58] Field of Search ..... 315/73, 74, 75, 106, 315/119, 340; 313/25, 184

[56] References Cited

FOREIGN PATENT DOCUMENTS

| | | | |
|---|---|---|---|
| 630536 | 5/1936 | Fed. Rep. of Germany | 315/73 |
| 1051948 | 12/1966 | United Kingdom | 315/73 |
| 267753 | 6/1969 | U.S.S.R. | 315/74 |

*Primary Examiner*—Saxfield Chatmon, Jr.
*Attorney, Agent, or Firm*—Darby & Darby

[57] ABSTRACT

A high intensity discharge lamp having an inner tube in which a discharge takes place to produce visible light and ultraviolet radiation and an outer envelope which blocks harmful ultraviolet radiation. An oxidizable element of a refractory metal is provided in the voltage supply to the arc tube internally of the outer envelope which element oxidizes when the outer envelope is broken and burns through to remove the voltage from the arc tube and to extinguish the arc.

5 Claims, 8 Drawing Figures

HIGH INTENSITY DISCHARGE LAMP WITH INTEGRAL MEANS FOR ARC EXTINGUISHING

This application is a division of our prior copending application Ser. No. 577,096 filed May 13, 1975, now U.S. Pat. No. 4,156,830 granted May 29, 1979, which is assigned to the same assignee.

High intensity discharge (HID) lamps such as mercury vapor, metal halide and high pressure sodium lamps, because of their high luminous efficacy, excellent lumen maintenance, relative low cost of light, good optical efficiency and ease of installation have been in general use for many years and are in increasing demand today. It has recently been publicized that all of these HID lamps present a potential health hazard.

The light emitting member of these lamps, namely, the arc tube containing quartz mercury vapor or metal halide, and the alumina high pressure sodium discharge tube, all contain mercury as at least one of the constituent fill components. The mercury vapor lamp arc tube uses only mercury as the fill component (except for argon starting gas) and the resulting lamp discharge yields the well known mercury high pressure line spectrum with infrared, visible and ultraviolet radiation. The metal halide tube uses mercury plus combinations of various metal halide compounds as the fill components in addition to argon starting gas. The resulting spectrum will be characteristic of the metal introduced, augmented by the mercury line spectrum. The high pressure sodium lamp is filled with mercury and sodium in addition to starting gases of argon, xenon or neon or mixtures thereof. The spectrum of the discharge of this lamp is characteristic of high pressure sodium augmented by the line spectrum of mercury. Therefore, although ionized and excited mercury atoms are not the primary light producing species in metal halide and high pressure sodium arc tubes and lamps, sufficient mercury ionization and excitation occurs to produce visible and ultraviolet radiation of the characteristic mercury spectrum.

The characteristic mercury spectral lines produced by the discharges of the foregoing types of lamps produce ultraviolet radiation in the 200–297 nanometer range. Ultraviolet radiation in this range is potentially harmful. For example, conjunctivitis, an inflammation of the conjunctivae, will cause visual incapacitation and is caused by exposure to 250–297 nanometer radiation. Conjunctivitis when inflicted by exposure to the ultraviolet radiation is insidious as its symptoms do not appear until 2½ to 12 hours after exposure to such radiation. Numerous cases of ultraviolet radiation exposure causing abiotically produced cataracts of the eye lens have been reported. Even when such ultraviolet producing sources are viewed from considerable distances eye injuries can occur by ocular absorption.

Hermetically sealed outer glass envelopes are usually used to surround the light emitting tubes of HID lamps. This is done for three main reasons: (a) to obtain proper warm up and operating vapor pressures of the fill components by providing an inert gas or vacuum atmosphere between the discharge tube and the outer envelope, (b) to prevent the slow deterioration, due to oxidation, of the discharge tube lead-in wires and (c) to prevent the lamp from radiating the harmful ultraviolet energy produced by the inner tube.

With respect to point (c), the glass composition of the outer envelope is chosen so as to achieve absorption of the ultraviolet range causing known harmful effects. Therefore, when the outer glass envelope is intact, the harmful ultraviolet radiation emitted by the discharge tube is absorbed. When, for one reason or another, the glass envelope is broken the hermetically sealed light emitting discharge tubes of these lamps will continue to operate for tens to hundreds of hours and will now emit their harmful ultraviolet radiation to the surrounding areas thus creating a health hazard to persons in those areas. An increasing number of HID lamps are used indoors where lamps, if operating with broken outer envelopes, will be of particular danger because of the likelihood of lamp installations in close proximity to people.

The present invention relates to a novel arrangement to be used in conjunction with an HID lamp, and as an integral component thereof, which operates to automatically extinguish the discharge when the outer lamp envelope is broken. In accordance with the invention, a switching element is placed in series with the lamp current supply in the outer envelope of the lamp. The switching element opens to interrupt the current supply in response to sensing that the envelope has been broken.

In one preferred embodiment of the invention disclosed, the switching element is an oxidizable member, such as a filament, which burns through when the lamp envelope breaks or otherwise is subjected to atmospheric air. The oxidizable element is in series with the current supply to the arc discharge tube. In one form of lamp the oxidizable element is connected in parallel with a thermostatic type switch. The switch closes after the lamp begins to operate normally and shunts the filament. When the outer envelope fails, the switch senses a decrease in temperature and opens to place the element in series with the current supply so that it can eventually burn through. In either case, when the envelope is broken, the element interrupts the current flow to the discharge and extinguishes it. In another embodiment of the invention, a mechanical type switch is located in the envelope in series with the current supply to the arc discharge tube. The switch is arranged to open when the envelope is broken.

It is therefore an object of the present invention to provide a high intensity discharge lamp of the type having an arc discharge tube within an envelope in which means are provided in the envelope to extinguish the arc when the envelope is broken.

An additional object is to provide a high intensity discharge lamp having a switching element to remove the current from the arc discharge tube when the lamp outer envelope is broken.

Another object is to provide a high intensity discharge lamp with a mechanical switch which opens when the envelope is broken to remove current from the arc tube to extinguish the arc and prevent harmful radiation from being produced.

A further object is to provide a high intensity discharge lamp having a filament in series with the current supply to the arc discharge lamp in which the filament burns out to remove the current when the lamp outer envelope breaks.

Other objects and advantages of the present invention will become more apparent upon reference to the following specification and annexed drawings in which.

Figure 1:
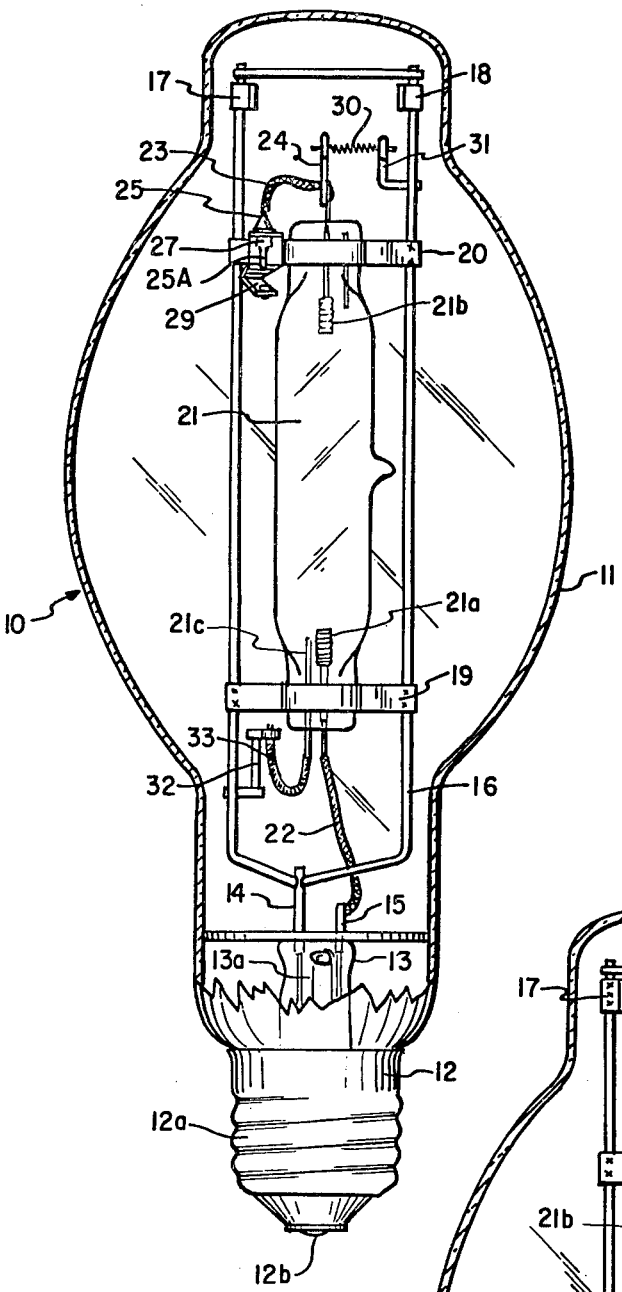
FIG. 1 is an elevational view of one embodiment of lamp according to the invention.

FIG. 1 shows a typical 400 watt mercury HID lamp 10 incorporating the element for extinguishing the discharge. The lamp 10 includes a generally tubular outer envelope 11 having a bulbous central portion with a conventional base 12 attached to the bottom. Extending inwardly from the base 12 and inside of the envelope 11 is a stem 13 having a tubulation 13*a* and a pair of stiff lead-in wires 14 and 15 in electrical conducting relation with the respective contact portions 12*a* and 12*b* of base 12.

Welded to the lead-in wire 14 is a generally rectangular arc tube mounting frame wire 16. Two springs 17 and 18 are welded to the frame wire 16 near its top to give strength to the completed mount within the envelope 11. The springs have legs (not shown) which contact the inner surface of the envelope. Two arc tube supports 19 and 20 of metal material are welded across the frame wire 16 and support a quartz arc tube 21 at its flattened ends. Arc tube 21 contains the usual main electrodes 21*a* and 21*b* and starting electrode 21*c*. One main electrode lead wire 22 of the quartz arc tube 21 is welded to lead-in wire 15. The other main electrode lead wire 23 is welded to a filament clamp 24 and a contact rod 25 of a normally open thermostatic switch 25A. The switch has a mounting bracket 26 which is welded to arc tube support 20. Contact rod 25 is electrically insulated from bracket 26 by an insulator 27 which can be, for example, of ceramic material. A thermostatic switch blade 29 is welded to bracket 26. Arc tube 21 also contains the discharge medium, mercury in the example being described. The appropriate medium could be used on other types of lamps.

A filament 30 is clamped between filament clamp 24 and a filament clamp 31 which is welded to frame wire 16. Filament 30 is preferably an incandescent filament. A starting resistor 32 is welded to frame wire 16 and to a starting electrode lead wire 33.

The lamp operates in the following manner. When voltage is applied to lead-in wires 14 and 15 through the proper ballast (not shown), voltage is applied to main electrode 21*a* over wire 22 and to the starting electrode 21*c* from lead-in 14, from 16, starting resistor 32 and lead 33. The other main electrode 21*b* receives voltage over lead-in 14, clamp 31, filament 30, and clamp 24. The arc will be struck in the arc tube in the usual manner and current will flow. After a period of time, as the mercury vapor pressure increases in the arc tube, the arc tube voltage will increase. This will increase the wattage dissipation of the arc tube and produce sufficient heat to cause the thermostatic switch blade 29 to close on the contact rod 25. This results in the short circuiting of filament 30.

The thermostatic switch 25A will remain closed during lamp operation. Therefore, no wattage will be dissipated in the filament section 30 allowing the lamp to operate as a normal rated HID lamp. After switch 25A closes, the lamp operates in the normal manner in that the arc discharge produces radiation both in the visible and invisible ranges, the latter including ultraviolet radiation in the potentially harmful range of 200–297 nm. This potentially harmful radiation is normally blocked by the outer envelope 11 whose material, for example a special glass, is capable of doing this.

If for some reason the outer bulb 11 breaks, the temperature necessary to keep thermostatic switch blade 29 closed is no longer maintained by the lamp. Thermostatic switch blade 29 therefore cools and opens allowing current to flow in filament 30. Since filament 30 is now burning in the air, it oxidizes rapidly and burns through. This interrupts the current flow in the circuit, and causes the discharge tube 21 to extinguish. Of course, once the arc extinguishes no more radiation is produced by the lamp and no harm can come to any person in the vicinity of the lamp.

In one example of lamp made in accordance with FIG. 1, a coiled filament of a 15 mm. long section of 0.0062 inch diameter tungsten wire wound on 0.017 inch diameter mandrel with a total wire length of 125 mm. was used. Two minutes after the lamp was ignited the thermostatic switch closed. The lamp was allowed to operate and stabilize after which time the outer envelope was purposely broken. The thermostatic switch opened within thirty seconds. Filament burn-through and arc extinguishing occurred ten seconds thereafter.

Filament 30 of the lamp of FIG. 1 is not intended to act as a ballasting element. In fact, it is preferably made so as to consume relatively little power of the lamp during start up. During running, the filament is shunted so that it consumes no power.

Figure 3:
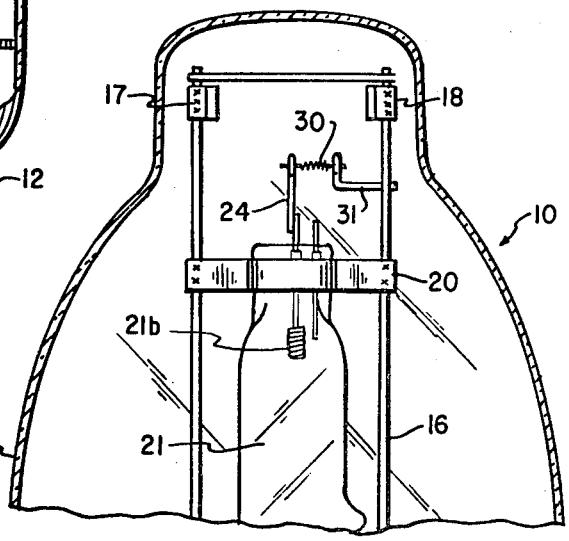
FIG. 3 is an elevational fragmental view of a further embodiment of the invention.

Another embodiment of the invention is detailed in FIG. 3. The same reference numerals are used as in FIG. 1. The difference between the lamps of FIGS. 1 and 3 is that the latter does not use a thermostatic switch in parallel with the filament 30. The operation of the lamp of FIG. 3 is similar to that of FIG. 1. When voltage is applied to lead-in wires 14 and 15 through the proper ballast, current will flow through the arc tube 21 and the filament 30 which is in the series circuit at all times. When the outer envelope 11 breaks the filament burning in air oxidizes rapidly and burns through interrupting the current flow in the circuit and causing the discharge in the quartz arc tube to extinguish.

Certain types of HID lamps exist in which a filament is used in series with the arc tube as a self-ballasting element and/or to contribute a significant amount of light to an HID lamp to improve the overall color rendition of the light produced by the lamp. Reference is made, for example to U.S. Pat. No. 3,445,719 to W. E. Thouret et al, which is assigned to the assignee of the subject application. In such lamps, the ballsting filament serves to stabilize the running current of the lamp. Therefore, it consumes a significant amount of the lamp power, for example, in the area of 40%–50%. In distinction to this, the oxidizable element of the subject invention is not used as a ballasting element. Instead, it is used to perform a switching, or fuse, function only. Therefore, its design is such as to minimize the amount of power that it consumes when operating. It is preferred that the filament consume no more than about five percent (5%) of the total power consumed by the lamp and its ballast. As indicated, the power consumption of the filament is made as small as possible, preferably in the range of one-three percent (1%–3%).

An actual lamp constructed according to the embodiment shown in FIG. 3 comprised a 400 watt qaurtz arc tube electrically in series with an 8 mm long coiled filament section 30 of 0.0093 inch diameter tungsten wire having a total filament wire length of 86 mm. With the required conventional mercury lamp ballast set to operate a regular 400 watt mercury lamp at 400 watts the following data was obtained for the test lamp:

Lamp Wattage: 405 watts
Lamp Current: 3.3 amperes
Lamp Voltage: 133 volts

By means of a special test lamp construction using an additional lead wire into the stem 13 and effecting an internal connection to the electrical junction of the arc tube main electrode lead wire 23 and filament clamp 24 the following additional component data are obtained:

Arc Tube Wattage: 395 watts
Filament Wattage: 10 watts
Arc Tube Voltage: 130.5 volts
Filament Voltage: 2.8 volts When the outer envelope of this lamp is purposely broken the burn through of filament 30 and arc extinguishing occurs in about 25 seconds. If the electrical characteristics of an HID lamp should be such that the lamp operates at or near minimum lamp current, time for filament burn-through to occur will increase. A 400 watt mercury lamp, operated on reactor ballast, constructed as shown in FIG. 3, which is operated at 2.8 amperes, (nominal current is 3.2 amperes) requires approximately 105 seconds for filament burn-through to occur after the outer envelope is broken. The temperature decrease of the inner arc tube of an HID lamp which occurs when the outer envelope is broken or shattered, reduces the vapor pressure within the tube. This is accompanied by a reduction in arc tube voltage and allows a higher voltage to appear across the reactor ballasting device, thus forcing more current through the lamp. This is a cumulative process and speeds the filament burn-through. Lamps operating on constant current ballasts will not be generally operated below 3.1 amperes. By increasing the power consumed by the filament, i.e. increasing its resistance, the burn through time can be decreased.

In the lamp of FIG. 3, the series connected oxidizable filament 30 added to the lamp construction to extinguish the discharge in case of outer bulb failure dissipates 10 watts. At the same time, arc tube wattage is reduced by 5 watts. Conventional reactive type HID lamp ballasts dissipate approximately 50 watts. A conventional lamp and reactive ballast combination therefore dissipates 450 watts while the lamp described here dissipates 455 watts. The 5 watt arc tube loss reduces total lamp lumen output by less than 1.5 percent and the filament consumes somewhat more than two percent (2%) of the total power of the lamp ballast system. In a self-ballasted lamp, the ballast filament can consume in the order of 40%–50% of the total lamp power in many cases.

The lamp construction and data can be altered to reduce the filament wattage further without sacrificing the essential safety feature of the device. The embodiment detailed in FIG. 1, of course, will dissipate no additional wattage and will operate the lamp at rated watts and lumen output because of the action of the thermostatic filament short circuiting switch.

Figure 4:
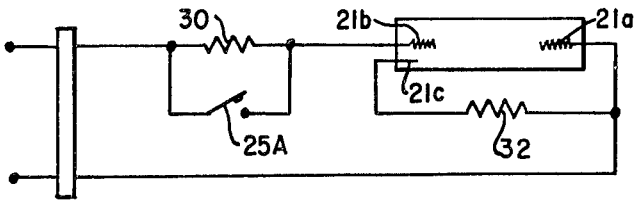
FIG. 4 is an electrical schematic of the embodiment of the invention of FIG. 1.

FIG. 4 is an electrical schematic of the embodiment of the invention of FIG. 1. Eliminating the thermostatic switch gives the embodiment of FIG. 2.

Figure 2:
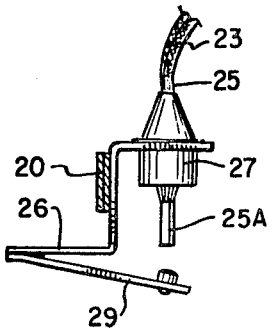
FIG. 2 is an enlarged view of a portion of the switching circuit of the lamp of FIG. 1.

In the embodiments of lamp shown in FIGS. 1–3, the arc is interrupted by the burning through of a filament. The filament consumes some power, unless it is shunted by a switch as in FIG. 1, and also there is a time delay before the filament reacts in air to burn through and open the circuit. In some cases, neither of these factors is desired or can be tolerated.

Figure 5:
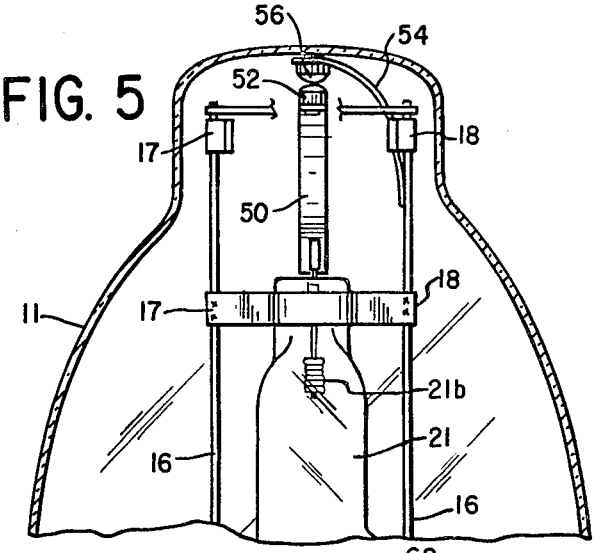
FIG. 5 is a fragmental elevational view of a part of a lamp according to another embodiment of the invention.
Figure 6:
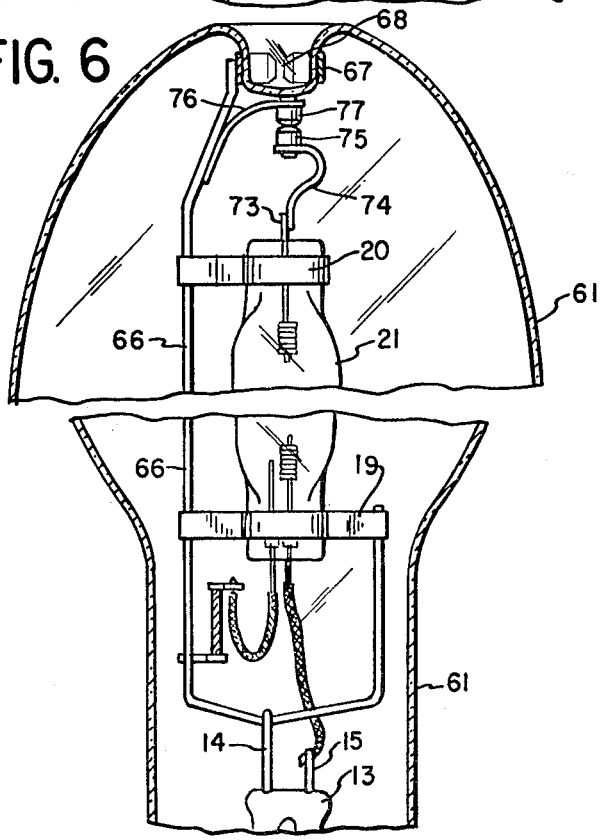
FIG. 6 is a fragmented elevational view of another embodiment of lamp.

FIGS. 5 and 6 describe further embodiments of lamps wherein a mechanical type switching arrangement which permits an HID lamp to operate at all times as a normal rated lamp on an existing ballast and to extinguish the arc instantly once the envelope is shattered or broken. In FIGS. 5 and 6, the same reference numerals are used where applicable as in the preceding Figures.

Figure 5A:
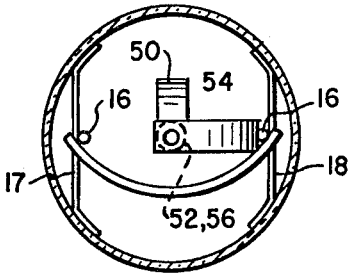
FIG. 5A is a top view of the lamp of FIG. 5.
Figure 5B:
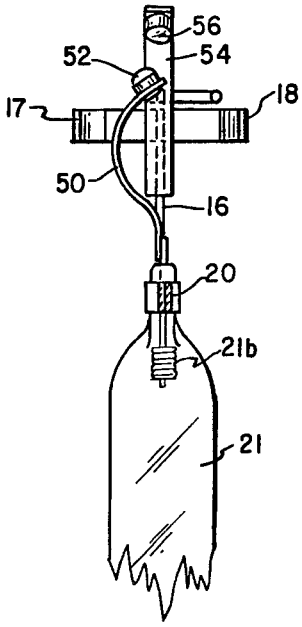
FIG. 5B is a view showing the switch before the lamp is assembled.

Referring to FIGS. 5, 5A and 5B, the lamp has the envelope 11, base 12, stem 13, lead-in wires 14,15 and lamp mounting frame 16. As before, the arc tube 21 is mounted in supports 19 and 20 attached to frame 16. Lead-in-wire 15 is connected to electrode **21*a* through a wire 22. The starting electrode 21*e* receives current through resistor 32 and lead 33, the former of which is connected to frame 16 which is, in turn, connected to lead 14**.

One end of a leaf spring 50 of electrically conductive material is attached, such as by welding, to the other main electrode **21*b*. An electrical contact 52 is located on the other end of spring 50. A second leaf spring 54 of electrically conductive material has one of its ends connected, such as by welding, to the frame support 16 and has a contact 56** on its other end.

FIG. 5B shows the leaf springs 50, 54 before the envelope 11 is sealed to the stem 13. As seen, the contacts 52 and 56 of the springs 50 and 54 are separated. When the envelope 11 is sealed to the stem 13, the weight of the envelope urges the two springs 50, 54 toward one another as the contact members 52, 56 are engaged. The side spring 17, 18 center the arc tube in the envelope. The weight of the envelope keeps the spring contacts 52, 56 in engagement during the envelope sealing in operation. If the force of the springs is large enough to tend to separate the envelope from the base during sealing, additional force can be applied to the top of the envelope.

Once the envelope is sealed to the base the two contacts 52,56 are held together. The lamp operates in the normal manner in that current is supplied to electrode **21*b* through lead-in wire 14, frame 16, and the springs 50, 54 and their respective contacts 52,56**.

The lamp of FIG. 5 operates in the normal manner without any increased power consumption or reduced light output until the lamp outer envelope is broken or shattered. At that time, the mechanical force of the envelope 11 needed to keep the two contacts pressed together is no longer present. Therefore, the two springs 50,54 move apart breaking the contact between the members 52,56. This interrupts the current to the arc tube electrode **21*b*** and the arc is extinguished immediately.

One preferred material for the leaf springs 50,54 is MONEL, an alloy of nickel, cobalt, copper, aluminum, iron, manganese, carbon, silicon, titanium, used in a thickness range of 0.010"–0.020". MONEL has the known excellent attribute of resiliency throughout the temperature range encountered in lamp processing and operation. It is easily shaped into desired configurations, easily and reliably spot welded and maintains its resiliency without fatigue throughout the long operating life expected of HID lamps. Contact materials and configurations for relatively high current capacities of 1–10 amperes are readily available and are in common use on parts such as thermostatic switches. A preferred contact is in the form of a composite rivet comprising a front disc, with a spherical radius, of pure tungsten or tungsten-silver mixture. 15% silver-85% tungsten, for example, has excellent contact properties combining good thermal conductivity and wear resistance. The disc is brazed to a nickel plated steel rivet which in turn is riveted to the spring for good electrical and mechanical contact. Riveting of either composite or single materials contacts is a known technique. Single materials, such as silver or copper can be employed and contact rivets are commercially available.

Various types of HID lamps may use or require different fill gases, gas mixtures or vacuum in the space between the arc tube and outer envelope to achieve proper tube operating vapor pressures and to prevent oxidation of metal lamp components. Neither the springs nor the contacts are affected as they will operate equally well in inert gases or vacuum. When the outer envelope breaks the contacts will always separate in the presence of air. The high nitrogen content of air will prevent arcing and sticking of the contacts due to the excellent quenching characteristics of nitrogen.

FIG. 6 shows a further embodiment of the invention adapted and applied to a conventional E-type envelope 61 having a general elliptical shape. The conventional base 12 is attached to the bottom as previously described. Extending inwardly from base 12 and inside the envelope 61 is a stem 13 having a pair of stiff lead-in wires 14 and 15 in electrical conducting relation with base 12. Welded to lead-in wire 14 is a frame wire 66 which is of somewhat different shape than the wire 16. Attached to frame wire 66 at its top free end is a flexible resilient collar 67 which engages the inwardly extending cylinder 68 of envelope 61 for the purpose of centering the arc tube mount within envelope 61, and providing the necessary rigidity and shock resistance.

Two metal arc tube supports 19 and 20 are welded to frame wire 66 and support arc tube 21. One main electrode lead wire 22 of arc tube 21 is attached to lead-in wire 15. The other main electrode lead wire 73 is welded to a flat leaf spring member 74 having a contact 75 fastened on its free end.

A second leaf spring 76 with a contact 77 is welded to frame wire 66. Spring 76 with contact 77 is forced against contact 75 and spring 74 due to the pressure exerted by the inside surface of cylinder 68 of envelope 61 during and after the sealing-in operation.

The lamp of FIG. 6 operates in the normal manner by supplying current to the arc tube 21 through the contacts 75,77 of springs 74,76. If the envelope is broken, the force needed to hold the two spring contacts together is removed and the contacts separate. This immediately extinguishes the arc.

The spring and contact system can utilize arrangements other than compression by the mutual forces existing between mount and inside top surface of the envelope. For example, a system can be used where pressure is exerted by the inside of the side tubular sections of the envelope as it engages the mount structure. In this case, two spring systems, 180° apart, may be preferred to prevent distorting and shifting the mount off the central longitudinal envelope axis.

While the lamps of FIGS. 1–4 are described with respect to a tungsten oxidizable coil, other oxidizable links, coils, wires or ribbons of molybdenum, iron, nickel-chromium, tantalum, copper, carbon or alloys thereof can be designed and utilized in the same or substantially similar manner. In each case the oxidizable element burns through, removes the current from the arc tube and extinguishes the arc.

Although the invention is generally described herein in connection with high pressure mercury lamps, it is also clearly applicable to metal halide and high pressure sodium lamps whose construction is substantially similar to that of mercury vapor HID lamps. The invention is also equally applicable to HID lamps using outer envelope fill gases of nitrogen, nitrogen-argon mixtures, or vacuum since thermostatic switches and oxidizing filaments can be designed to operate in these atmospheres.

The circuit diagram of FIG. 4 applies generally to the lamps of FIGS. 5 and 6. In this case, however, the filament 30 would be omitted and the switch 25A would correspond to the switch formed by the spring contacts 50,54.

FIG. 4 illustrates another feature of the invention. In this figure, the starting electrode 21C is shown located adjacent the electrode **21*b* instead of electrode 21*a* as in FIGS. 1, 5 and 6. In the case where starting electrode 21*c* is located adjacent main electrode 21*a* and the electrodes are connected to the lead-ins 14 and 15, voltage still would be applied to both electrodes after the switching element opened. This would produce a glow after the arc tube cools between the two electrodes due to the reaction of the metal element and starting gas with the electrodes. As shown in FIG. 4, if the starting electrode 21*c* is located adjacent electrode 21*b*, which is in series with the switching element, electrode 21*b*** would not receive any voltage after the switching element opened. In the latter case, no glow would be produced.

What is claimed is:

1. A safety protected high intensity arc discharge electric lamp for a ballasted type circuit which operates with a ballast means and supplies a predetermined value of voltage and current with said lamp having a nominal design rated life, comprising a first envelope having means therein for producing in response to an applied voltage an arc discharge emitting optical radiation at least a portion of which is in the visible range and radiation in a range which is potentially harmful to humans, means for applying voltage to the arc discharge producing means of said first envelope to produce the arc therein, and a second normally sealed envelope within which the first envelope is mounted, said second envelope being of a material to block the potentially harmful radiation, said means for applying voltage including safety means comprising an oxidizable resistively heated element of a refractory metal within said second envelope, said element designed for operation at the rated operating voltage and current of the lamp without significantly degrading its design rated life and consuming from about 1% to about 3% of the total power consumed by the lamp and ballast means, said element being responsive to the breaking of the second envelope which admits a significant quantity of atmospheric air and exposure to the atmospheric air only to oxidize to the point when it breaks within a substantially predetermined time in the range of from about twenty-five seconds to about one hundred and five seconds to interrupt the voltage to the arc discharge producing means to thereby extinguish an existing arc and prevent the production of the potentially harmful radiation which could be radiated through the broken portion of the outer envelope.

2. A lamp as in claim 1 wherein the means for producing the arc discharge includes main electrode means at each end of said first envelope and a starting electrode adjacent one of said main electrode means, said safety means for interrupting the voltage connected to electrically disconnect one of the starting electrode and main electrode means adjacent to it from the means for applying the voltage.

3. A lamp as in claim 1 wherein said oxidizable element is an incandescent filament.

4. A high intensity arc discharge lamp as in claim 3 wherein said filament is formed of tungsten wire.

5. A high intensity arc discharge lamp as in claim 1 wherein the oxidizable element is a filament.

* * * * *